US009016895B2

(12) United States Patent
Handsaker

(10) Patent No.: US 9,016,895 B2
(45) Date of Patent: Apr. 28, 2015

(54) LED LIGHTING FIXTURE WITH RECONFIGURABLE LIGHT DISTRIBUTION PATTERN

(75) Inventor: Jerry Handsaker, Roland, IA (US)

(73) Assignee: Innovative Lighting, Inc., Roland, IA (US)

( * ) Notice: Subject to any disclaimer, the term of this patent is extended or adjusted under 35 U.S.C. 154(b) by 132 days.

(21) Appl. No.: 13/075,494

(22) Filed: Mar. 30, 2011

(65) Prior Publication Data

US 2012/0250309 A1 Oct. 4, 2012

(51) Int. Cl.
*F21V 1/00* (2006.01)
*F21V 5/04* (2006.01)

(52) U.S. Cl.
CPC ..... *F21V 5/04* (2013.01)

(58) Field of Classification Search
CPC ..... F21V 5/04
USPC ..... 362/235, 311.02, 249.02; 99/235, 99/311.02, 249.02
See application file for complete search history.

(56) References Cited

U.S. PATENT DOCUMENTS

| | | | | |
|---|---|---|---|---|
| 6,149,288 | A * | 11/2000 | Huang | 362/545 |
| 7,914,162 | B1 * | 3/2011 | Huang | 362/92 |
| 7,976,194 | B2 * | 7/2011 | Wilcox et al. | 362/268 |
| 2007/0153521 | A1 * | 7/2007 | Konuma | 362/268 |
| 2008/0192478 | A1 * | 8/2008 | Chen | 362/294 |
| 2008/0219002 | A1 * | 9/2008 | Sommers et al. | 362/247 |
| 2009/0103299 | A1 * | 4/2009 | Boyer et al. | 362/237 |
| 2010/0073783 | A1 * | 3/2010 | Sun | 359/822 |
| 2010/0110684 | A1 * | 5/2010 | Abdelsamed et al. | 362/249.02 |

* cited by examiner

*Primary Examiner* — Evan Dzierzynski
(74) *Attorney, Agent, or Firm* — Daniel J. Polglaze; Westman, Champlin & Koehler, P.A.

(57) ABSTRACT

A lighting fixture utilizing light emitting diodes and easily reconfigurable lenses to provide customizable lighting patterns to more efficiently illuminate work or storage areas.

18 Claims, 9 Drawing Sheets

LED LIGHTING FIXTURE WITH RECONFIGURABLE LIGHT DISTRIBUTION PATTERN

FIELD OF THE INVENTION

The present invention relates to a wide area LED lighting fixture as would be used in a storage warehouse, manufacturing floor or the like.

BACKGROUND OF THE INVENTION

Lighting systems traditionally used in wide area applications such as storage warehouses or manufacturing floors are wasteful in their distribution of light because much of their illumination falls on the tops of pallet racks, palletized goods or manufacturing equipment. Common lighting systems of this type include a variety of high intensity discharge lamps such as metal halide, mercury vapor, lead-gallium, high pressure sodium, etcetera. Another common solution for lighting such an area is florescent lamps. These standard methods of general illumination of wide areas are limiting as their light output is wasteful by not being very well controlled and therefore the conventional remedy for inadequate lighting in areas covered by this sort of blanket lighting solution is to add additional light fixtures and therefore increase cost in capital, maintenance and energy usage.

If the area for illumination is a generally flat area, such as an athletic field, dance floor or open stage, the blanket method of distribution of light from these type of lamps may be adequate in generally illuminating the area, but in a warehouse or manufacturing floor type situation, general illumination from a distributed pattern of high intensity lights creates shadows, outlines and dim areas due to the large amounts of the lamp's output falling on the tops of storage racks, stored product and/or manufacturing machines.

High intensity discharge lamps have many drawbacks in a warehouse and manufacturing area application. Typically a warehouse or manufacturing structure is built with a pattern of equidistantly spaced lamps to illuminate a flat floor area to a certain brightness. It is uncommon to consider equipment or storage rack layout prior to installation of a standard grid of lights. Even if such considerations are made initially, the lighting scheme becomes impractical once the warehouse or manufacturing floor layout is changed. Changing the location of high intensity discharge lamps is difficult as the fixtures are heavy and require the replacement of metal conduit for their high voltage AC power supplies, and the lamps require connection to a suitable roof truss or robust support element due to the weight of the fixtures.

Due to the nature of high intensity discharge lamps it is extremely difficult to direct the light output in a manner precise enough for the purposes of creating defined illumination areas for warehouse or manufacturing operations. The complexity of the optics, heat issues and the uncontrollability of vast quantities of light makes the concept of customizable light pattern outputs unrealistic.

Florescent lamps overcome some of the problems experienced with high intensity discharge lamps as they have somewhat less complicated and demanding fixtures and can be reconfigured to new warehouse or manufacturing floor layouts with less effort. Due to the necessity of forklifts and other equipment in such areas, florescent light fixtures still have to be located above the uppermost levels of most storage racks or manufacturing equipment and due to the wide radiant light output pattern of florescent lights a substantial amount of the light is left illuminating the tops of storage racks or the upper surfaces of manufacturing equipment which results in a great deal of wasted or misspent light. Even in the best of florescent light strategies, where the lighting fixture is located directly above an aisle, a great deal of light is still directed at the tops of pallet racks, product on the racks or the tops of manufacturing equipment, the second most illuminated area is the unobstructed floor and the lowest percentage of light is left to dimly illuminate the product labels on the sides of palletized products or the warehouse addresses on the pallet racks where the light is most needed.

Therefore what is needed is an efficient lighting fixture that is sufficiently light of weight and easy to relocate to allow for ease of reconfiguration of the lighting fixture, that includes an easily reconfigurable means of directing portions of the light it produces into designated patterns that can be configured to conform to the areas of desired illumination within a warehouse or onto the manufacturing floor or similar area.

SUMMARY OF THE INVENTION

To meet these needs, the present invention provides a lighting fixture that utilizes high intensity light emitting diodes (LEDs) for efficiency of weight, size and energy consumption and that can be easily re-hung or rearranged to meet the changing needs of a warehouse or manufacturing area layout. Each individual LED light source includes one of several lenses to direct the light in a particular direction resulting in a lighting pattern. The use of different lenses will create a specific and precise illumination area or footprint that can be designed particular to the lighting needs that exist below the placement of the fixture. The fixture itself is easily reconfigurable to produce different light output patterns to conform to the changing environment. When the warehouse or manufacturing floor is so illuminated, the amount of waste light falling on unwanted areas will be reduced resulting in a surgically efficient use of light conforming to the topographic irregularities of the illuminated area and therefore resulting in a lowered cost in energy, a lower number of fixtures and less maintenance, while maintaining satisfactory lighting where the light it is required for efficient operation.

One aspect of the present invention is that the illumination footprint of any fixture can be changed easily, even while the fixture is suspended from the ceiling as new lenses for each individual or set of LEDs can be easily replaced.

Another beneficial aspect of the present invention is that the LED lighting fixture does not require ballast and has longer operational duration than fluorescent types of lighting. The lighter weight of the fixture also increases the ease of relocating the light fixture when there are changes to the floor plan.

Yet another aspect of the present invention is that it is powered by a low voltage DC power source that does not require metal conduit or AC type heavy cabling when installing or reconfiguring. DC power systems also lend themselves to easy and efficient remote or interactive control.

A yet additional aspect of the present invention is that LEDs do not suffer the long turn-on times experienced with high intensity lamps or florescence lamps especially when operating in a refrigerated warehouse or manufacturing area. Additionally, LED lighting produces little heat to confound environmental equipment in temperature controlled areas.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DETAILED DESCRIPTION OF THE PREFERRED EMBODIMENTS

In the following detailed description, reference is made to the accompanying drawings which form a part hereof, and in which is shown by way of illustration specific embodiments in which the invention may be practiced. These embodiments are described in detail sufficient to enable those skilled in the art to practice the invention, and it is to be understood that other embodiments may be utilized and that structural, logical and mechanical changes may be made without departing from the spirit and scope of the present invention. The following detailed description is, therefore, not to be taken in a limiting sense, and the scope of the present invention is defined by the appended claims.

Figure 1:
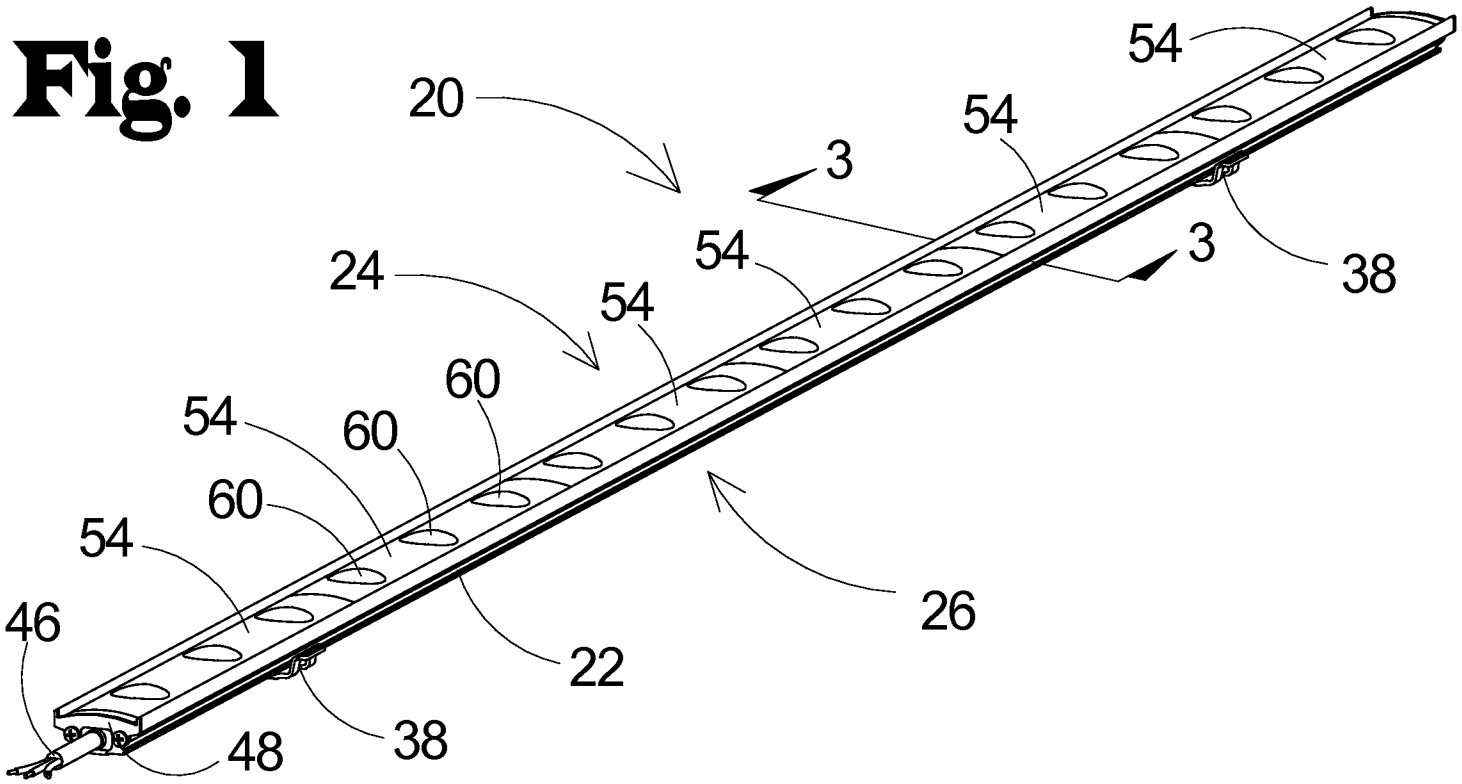
FIG. 1 is a perspective view showing the bezel side of an embodiment of the present invention.
Figure 2:
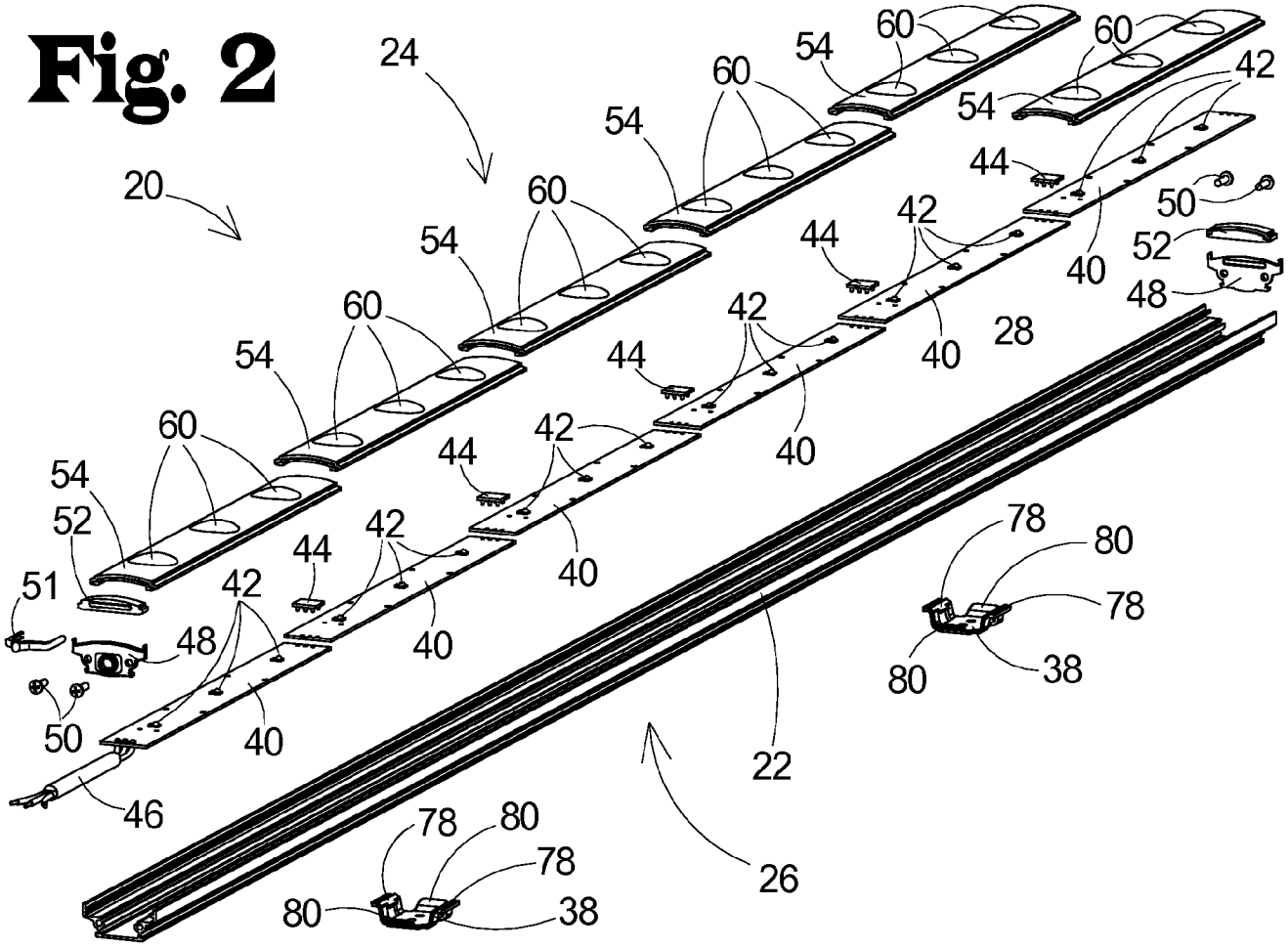
FIG. 2 is an exploded view of the embodiment of FIG. 1.
Figure 3:
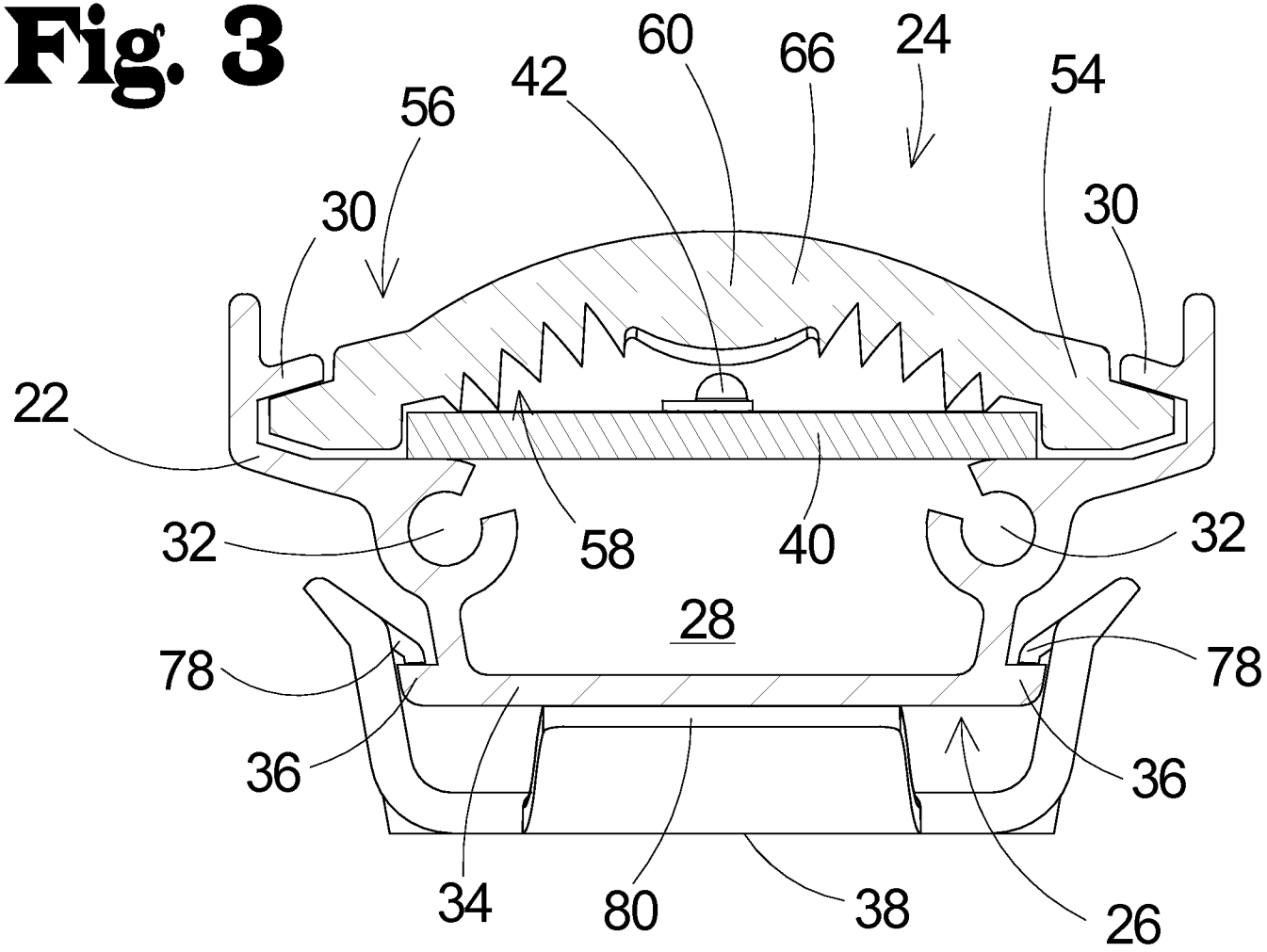
FIG. 3 is a cross-sectional view of the embodiment of FIG. 1 utilizing a bilateral lens.

Illustrated in FIGS. 1-3 is an embodiment of an LED light fixture (20). The fixture base (22) consists of an elongated stanchion with a generally crescent shaped cross section. The semi-enclosed side of the fixture base (22) is referred to as the bezel side (24) which is opposite from the back side (26). The back side (26) includes a flat section referred to as back plate (34). The depression running the length of the bezel side (24) is referred to as trough (28).

In the preferred embodiment fixture (20), the fixture base (22) consists of extruded aluminum because the material is light, easily fabricated, economical, and has the added benefit of sinking and evenly distributing heat generated by the light emitting diodes or "LEDs" (42). It is anticipated the fixture base (22) could alternately be fabricated from other materials including but not limited to other metals, alloys, plastics, glass reinforced resins, carbon filaments, or ceramics.

The fixture base (22) is illustrated in the drawings as being six foot in length just for the purpose of example and the invention is not so limited. It is anticipated the fixture base (22) could be of any length appropriate to the industrial lighting application. It is also anticipated that a number of fixture base (22) members could be combined in a single LED lighting fixture (20).

As illustrated in FIG. 1, six bezels (54) are retained by the fixture base (22) on the bezel side (24), each bezel (54) includes three integrated lenses (60). This configuration of bezels (54) and lenses (60) is merely illustrative and not limiting, as it is anticipated that the number of bezels (54) or the number of lenses (60) per bezel (54) could vary according to the needs of application, manufacture or cost. In the embodiments illustrated the bezel (54) and lens (60) are formed from a single piece of transparent material, including but not limited to; acrylic, polycarbonate, butyrate crystal or glass. The type and orientation of the lens (60) would be specific to the bezel (54) although it is anticipated that the lens (60) could be a separate insert within the bezel (54).

Attached to the back side (26) of the fixture base (22), are two mounting clips (38). The mounting clip (38) can be placed anywhere along the back side (26) of the fixture base (22) by gripping the opposing mounting flanges (36) which are formed by the sides of the back plate (34) of the fixture base (22). The mounting clip (38) provides a intermediate mounting element between the LED lighting fixture (20) and other mounting apparatus including but not limited to such elements as lines, cables, plates, flanges, rails, stanchions, joists, etcetera, for the purposes of positioning the LED lighting fixture (20). The mounting clip (38) employs a pair of opposed, spring biased, tabs to engage the mounting flange (36) and encompass a section of the back plate (34).

At each end of the LED lighting fixture (20) an end cap (48) is included to retain the LED lighting fixture's (20) component parts. The length of the fixture base (22) and the design of the bezels (54) are calculated to place the LED (42) in relation to the lens (60) so as to produce a light output pattern (70) that could be characterized by a specific illumination footprint (72). The end cap (48) would serve to secure the bezels (54) to the fixture base (22) to achieve the LED (42) lens (60) relationship. As seen in FIG. 1, the end cap (48) may include an aperture to allow throughput of the electrical conductors (46); alternately the end cap (48) may not include such an aperture.

The end cap (48) is held in place by a fastener (50). FIG. 2 illustrates two different types of fasteners, the first is the use of a pair of self threading screw fasteners (50), the other is a tension biased caliper fastener (50) that would allow a quick tool-less access to the bezel (54) or the printed circuit board (40). The fasteners (50) illustrated are typical self threading metal screws but the invention is not so limited. It is anticipated that a wide variety of fastening devices could be employed, including but not limited to biased clips, rivets, hooked members, threaded connectors, tension clasps, staples, quick release fastener (51), etcetera. An end cap (48)

employing a hand operated, quick release fastener (51) allows for quick and easy bezel (54) replacement without the need for tools.

The fasteners (50) engage fastener revivers (32) which are a part of the fixture base (22). In the illustrated embodiment the fastener receivers (32) take the form of crescent shaped cavities of the extrusion into which a self threading screw type fastener (50) could engage its threads. As evident to those skilled in the art reciprocal design elements of the fixture base (22) could be employed for any of the other fastener types formerly anticipated.

FIG. 2 is an exploded view of the embodiment demonstrated in FIG. 1. This view affords a view of the printed circuit board "PCB" (40) onto which the LED (42) is mounted. The LED (42) in this embodiment is a "high intensity light emitting diode" that has a volume of light appropriate to the area to be illuminated. In the drawing there are three LEDs (42) mounted to six individual PCBs (40) but this configuration is only illustrated as an example. It is anticipated that a single PCB (40) could run the full length of the fixture base (22) including all eighteen LEDs (42) or that the ratio of LEDs (42) to PCBs (40) is one to one. This configuration of PCBs (40) and LEDS (42) is merely illustrative and not limiting, as it is anticipated that the number of PCBs (40) or the number of LEDs (42) per PCB (40) could vary.

Noticeable in the illustrations is the consistency of LEDs (42) with the number lenses (60) but this too, is just and example of an efficient and easily manufactured embodiment as it is anticipated that clusters of LEDs (42) could be mounted in relation to a single lens (60) to produce the same desired effect.

In the illustrated embodiment the PCBs (40) are electrically connected to one another by PCB connector clips (44). The PCB connector clips (44) include a number of electrical conductive conduits to pass electricity from PCB (40) to PCB (40) in a series or parallel scheme. The clips may also provide a mechanical means to hold the PCBs (40) to each other and retain the PCB (40), and therefore the LEDs (42), in the proper orientation with respect to the lens (60).

At the either end of the fixture base (22) the PCB (40) can be connected to either a power source, or to another LED lighting fixture (20) through the agency of electrical conductors (46). Since the electrical conductors (46) are not limited to providing power from the power source, some of the electrical conductors (46) could include control circuitry for direct remote control or control via an interactive system, such as motion sensors, timers, microprocessor input or via networked signals.

FIG. 2 also shows a choice of fasteners (50) one choice includes a standard set of screw type fasteners (50), the other is a quick release fastener (51) which comprises a pair of gripping fingers that engage both fastener receivers (32) within the fixture base (22) incorporated with a tension biased hinge which would allow a tool-less quick release from the channels of the fastener receivers (32).

It may be desirable in some applications to include a bezel gasket (52) between the end cap (48) and bezel (54) to compress the bezels (54) against one another to prevent open gaps into the interior of the LED lighting fixture (20) where dust, fumes, vapors and debris may enter.

FIG. 3 is a cross section of the LED lighting fixture (20) at the intersection of a bilateral lens (66) and an LED (42). This view better illustrates the system for retaining the bezel (54) within the trough (28) of the fixture base (22) through the agency of bezel flanges (30) integrated into the cross sectional extrusion of the fixture base (22). The pair of bezel flanges (30) forms a double falcate shape or channel into which the sides of the bezel (54) may be inserted.

In FIG. 3 the mounting clip (38) shown includes a pair of tension clips with tabs (78) that engage, mounting flange (36) integrated into the length of the fixture base (22). A pair of bias leaves (80) also provide constant tension against the back plate (34) assuring a fixed grip at all times. This design allows the mounting clip (38) to be fixed to any portion of the length of the fixture base (22).

The bezel (54) shown in FIG. 3 is at the midpoint of a bilateral lens (66). The bezel face (56) defines the exterior or bezel side (24) of the LED lighting fixture (20). The opposite face, generally disposed to the interior of the LED lighting fixture (20) is referred to as the bezel interior (58). The bezel interior (58) side of the bilateral lens (66) demonstrates the topography that produce the light output pattern (70) that defines the illumination footprint (72).

The PCB (40) fits in a cavity formed within the bezel interior (58) and the fixture base (22). In the illustrated embodiment the part of the fixture base (22) contacting the PCB (40) is the material constituting the fastener receiver (32) but it is anticipated that other design elements of the fixture base (22) could provide a suitable retention means.

Figure 4A:
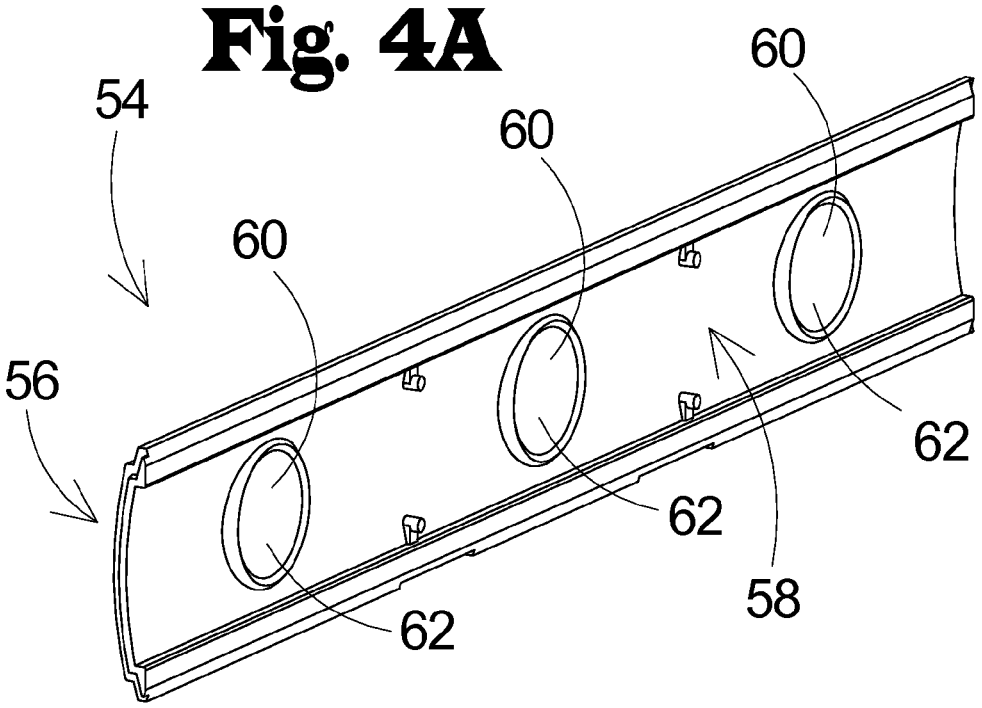
FIG. 4A is a perspective view showing the bezel interior side of a round lens bezel of an embodiment of the present invention

FIG. 4A demonstrates the bezel interior (58) of a bezel (54) integrated with three round lenses (62). The round lens (62) redirects much of the light radiating omni-directionally from the LED (42) to focusing the majority of the light output pattern (70) perpendicular to the bezel face (56) to provide a generally round illumination footprint (72).

Figure 4B:
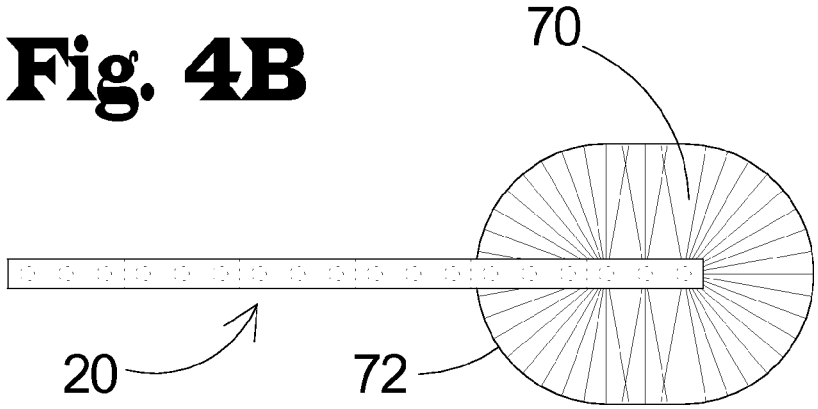
FIG. 4B is a schematic view of the illumination footprint of three round lenses of an embodiment of the present invention.

FIG. 4B is a plan view of a LED lighting fixture (20) wherein the bezel (54) on the far right end has been integrated with round lenses (62). The light output pattern (70) from each individual LED (42) and lens (60) is generally equally radiant in all directions but the use of three LED (42) and lens (60) combinations produces a slightly oval illumination footprint (72).

Figure 5A:
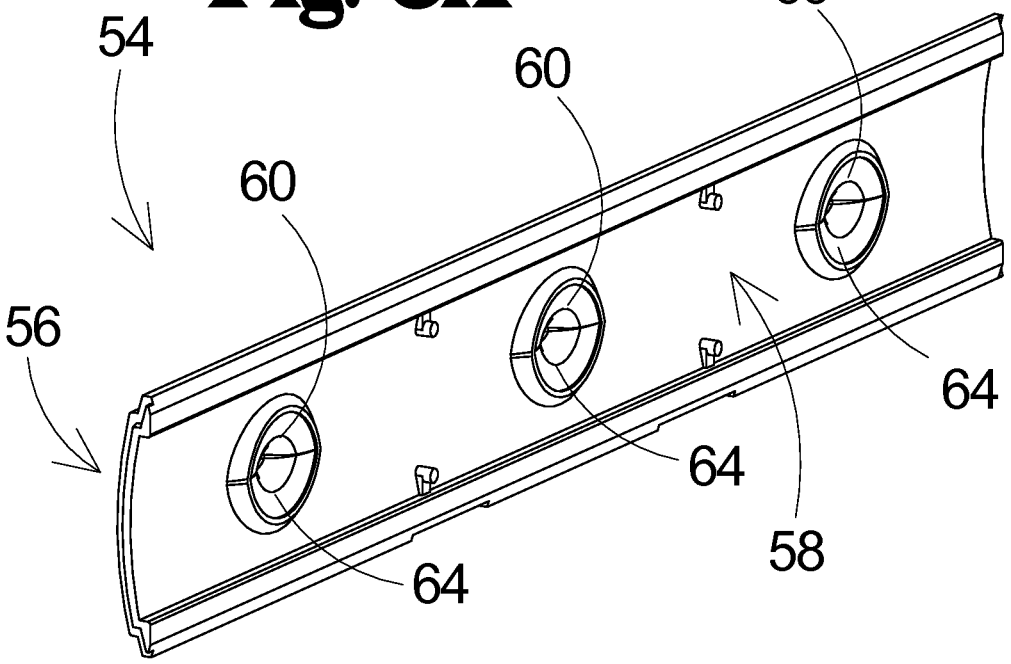
FIG. 5A is a perspective view showing the bezel interior side of a cat-eye lens bezel of an embodiment of the present invention

FIG. 5A demonstrates the bezel interior (58) of a bezel (54) integrated with three cat-eye lenses (64). The cat-eye lens (64) redirects much of the light radiating omni-directionally from the LED (42) in a linear light output pattern (70) resembling a bilaterally flattened cone or triangular shape from the bezel face (56) to provide a significantly elongated elliptical illumination footprint (72).

Figure 5B:
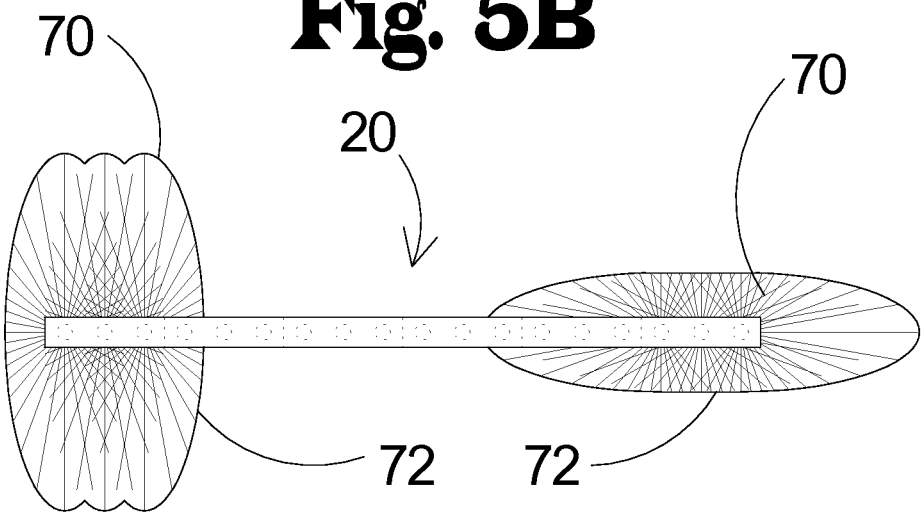
FIG. 5B is a schematic view of the illumination footprint of two applications of a combination of three cat-eye lenses of an embodiment of the present invention.

FIG. 5B is a plan view of a LED lighting fixture (20) wherein the bezel (54) on the far right end has been integrated with cat-eye lenses (64). The light output pattern (70) from each individual LED (42) and lens (64) forms an elongated ellipse oriented along the length of the LED lighting fixture (20) but the use of three LED (42) and lens (64) combinations produces an even more elongated oval illumination footprint (72). The bezel (54) on the far left end of the LED lighting fixture (20) also utilizes three cat-eye lenses (64) but the lenticular topography of the cat-eye lenses (64) has been rotated 90° thereby reorienting the elongated ellipse from extending parallel to the length of the LED lighting fixture (20) to extending perpendicular to the length of the LED lighting fixture (20). The illumination footprint (72) thus produced from this light output pattern (70) is closer in shape to a rectangle. It is anticipated that the lenses (64) integrated into the bezel (54) could be oriented in any direction producing a variety of illumination footprints (72).

Figure 6A:
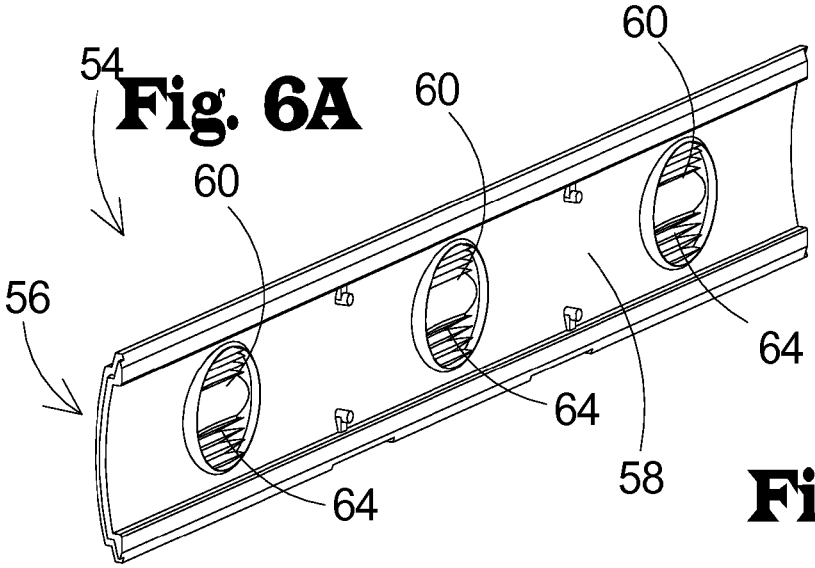
FIG. 6A is a perspective view showing the bezel interior side of a bezel integrated with a bilateral lens of an embodiment of the present invention.

FIG. 6A demonstrates the bezel interior (58) of a bezel (54) integrated with three bilateral lenses (66). The bilateral lens (66) redirects much of the light radiating omni-directionally from the LED (42) in a light output pattern (70) resembling pair of focused crescents, wherein the central bilaterally flattened cone, similar to the output of the cat-eye lens (64), receives much less light that the remaining section of the cone, formed by the round lens (62). This light output pattern (70) creates a generally rectilinear illumination footprint (72) but also provides a larger majority of light when used to provide light along a vertical axis.

Figure 6B:
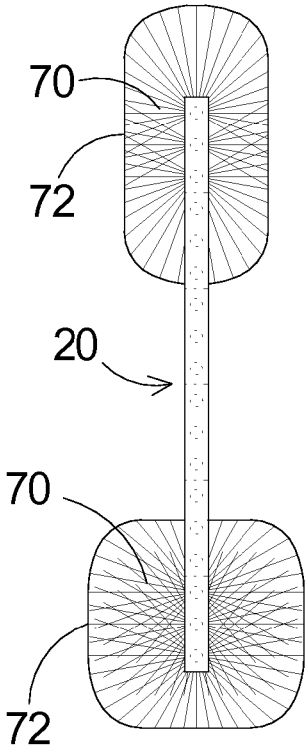
FIG. 6B is a schematic view of the illumination footprints of two applications of a combination of three bilateral lenses of an embodiment of the present invention.

FIG. 6B is a plan view of a LED lighting fixture (20) wherein the bezel (54) on the top end has been integrated with bilateral lenses (66). The light output pattern (70) from each individual LED (42) and lens (66) forms an ellipse oriented along the length of the LED lighting fixture (20). The use of three LED (42) and lens (66) combinations produces a slightly wider illumination footprint (72). The bezel (54) on the bottom end of the LED lighting fixture (20) also utilizes three bilateral lenses (66) but the lenticular topography has been rotated 90° thereby reorienting the ellipse from extending parallel to the length of the LED lighting fixture (20) to extending perpendicular to the length of the LED lighting fixture (20). The illumination footprint (72) thus produced from this light output pattern (70) is generally square.

Figure 6C:
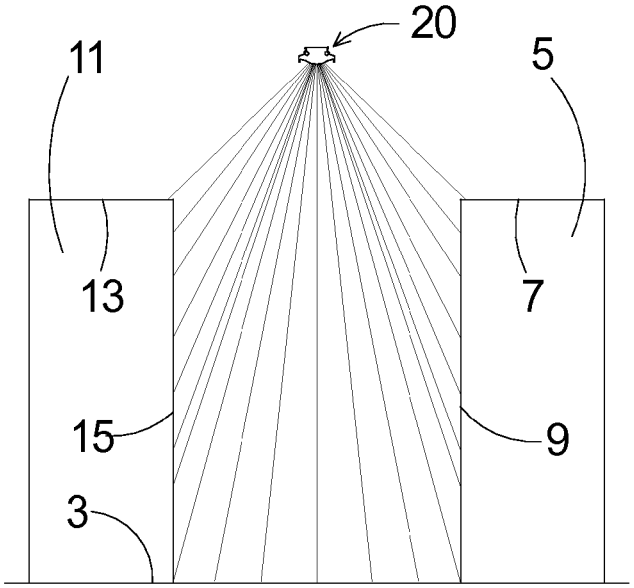
FIG. 6C is a profile view showing light output pattern of an embodiment of the bilateral lens of the present invention.

FIG. 6C is a profile view demonstrating the advantage of the bilateral lens (66), wherein it is necessary to provide a light output pattern that provides lighting to the sides so that vertical surfaces, such as palette racks (5), shelves or machinery sides (15) of vertically oriented manufacturing machinery (11), requires more light than the floor (3) to maintain the same ambient luminosity.

Figure 7A:
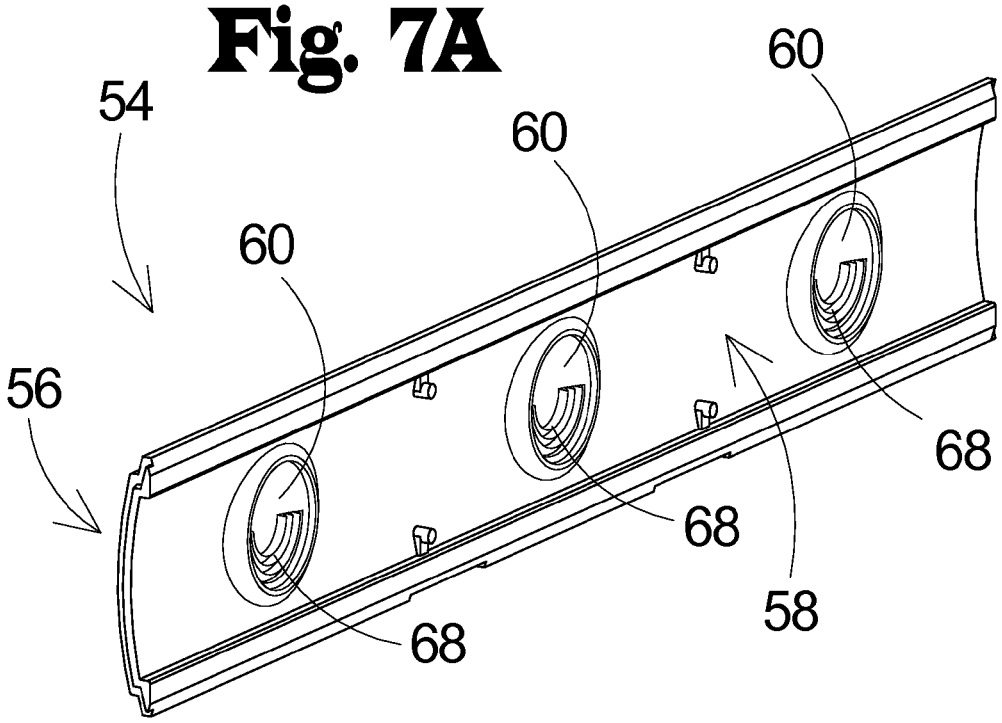
FIG. 7A is a perspective view showing the bezel interior side of a unilateral lens bezel of an embodiment of the present invention.

FIG. 7A demonstrates the bezel interior (58) of a bezel (54) integrated with three composite lenses (68). The composite lens (68) is a combination of the lenticular effects of one half of the round lens (62) on one half of the lens (68) and the lenticular effects of one half of the bilateral lens (66) on the other half. This composite lens (68) redirects much of the light radiating omni-directionally from the LED (42) in a generally circular shape in one direction and in a concentrated crescent to in the opposite direction providing a light output pattern (70) composite to the dichotomous effects of the round lens (62) and the bilateral lens (66) resulting in an illumination footprint resembling a capital "D". It is anticipated that different types of lenses (60) or their constituent lenticular effects could be combined in multiple combinations to produce a plurality of composite lenses (68) that would each produce particular light output patterns (70) and illumination footprints (72).

Figure 7B:
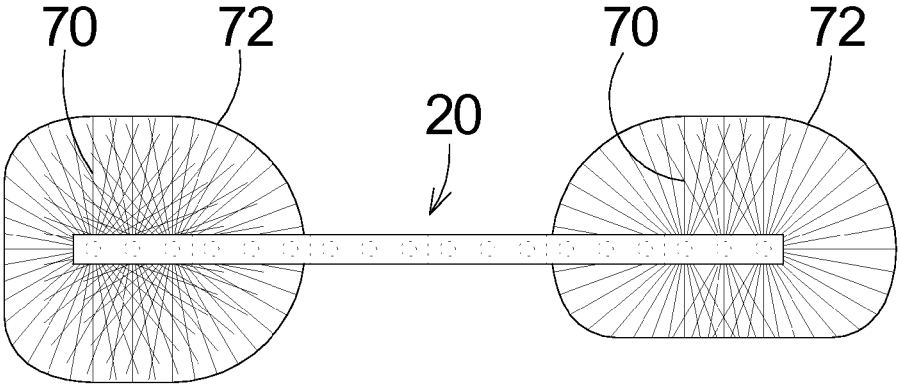
FIG. 7B is a schematic view of the illumination footprint of two applications of a combination of three unilateral lenses of the present invention.

FIG. 7B is a plan view of a LED lighting fixture (20) wherein the bezel (54) on the far right end has been integrated with composite lenses (68). The light output pattern (70) from each individual LED (42) and lens (68) is generally "D" shaped. The use of three LED (42) and lens (68) in combination produces a taller or narrow "D" shape. Illumination footprint (72) of the bezel (54) on the far left side, wherein the composite lenses (68) have been rotated 90° produces a shorter or wider "D" shape.

It is anticipated that a wide variety of lenses (60) using a plurality of lenticular effects, either singularly or in combination, could produce a profusion of light output patterns (70) producing an almost countless number of illumination footprints (72). The four lenses (60) expressed in this specification merely represent an group of examples used to illustrate the concept of the use of custom light output patterns (70) to light those parts of a building interior that require light for operation while not wasting light on those areas that are not required to be illuminated in the course of their operation.

Figure 8:
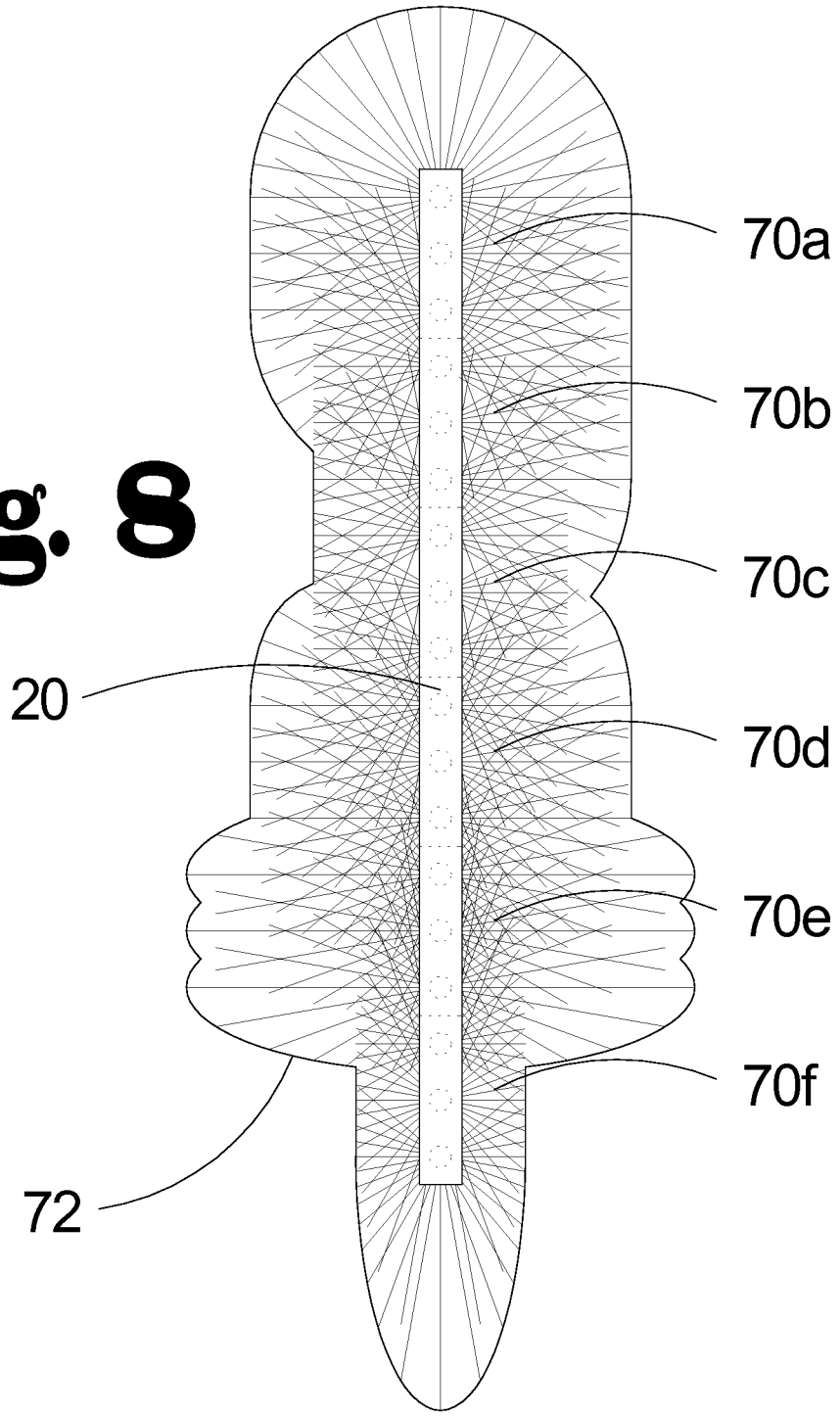
FIG. 8 is a schematic view of a customized illumination footprint produced by a single fixture using a variety of lenses of an embodiment of the present invention.

FIG. 8 is a schematic diagram of a unique illumination footprint (72) formed by various light output patterns (70) created by utilizing a number of bezels (54) including a variety of lenses (60). The top most light output pattern (70*a*) is produced with round lenses (62). The second light output pattern (70*b*) down from the top is produced using unilateral lenses (68) wherein the round lens (62) half is oriented to the right and the bilateral lens (66) half is oriented to the left. The third light output pattern (70*c*) down from the top is produced using bilateral lenses (66) wherein the concentrated light is projected perpendicular to the length of the LED lighting fixture (20). The forth light output pattern (70*d*) down from the top is produced using round lenses (62) exactly like the light output pattern (71*a*) at the top. The fifth light output pattern (70*e*) down from the top is produced with cat-eye lenses (64) which have their elongated ellipse oriented perpendicular to the length of the LED lighting fixture (20). The bottom most light output pattern (70*f*) is produced with cat-eye lenses (64) which have their elongated ellipse oriented parallel to the length of the LED lighting fixture (20).

Figure 9:
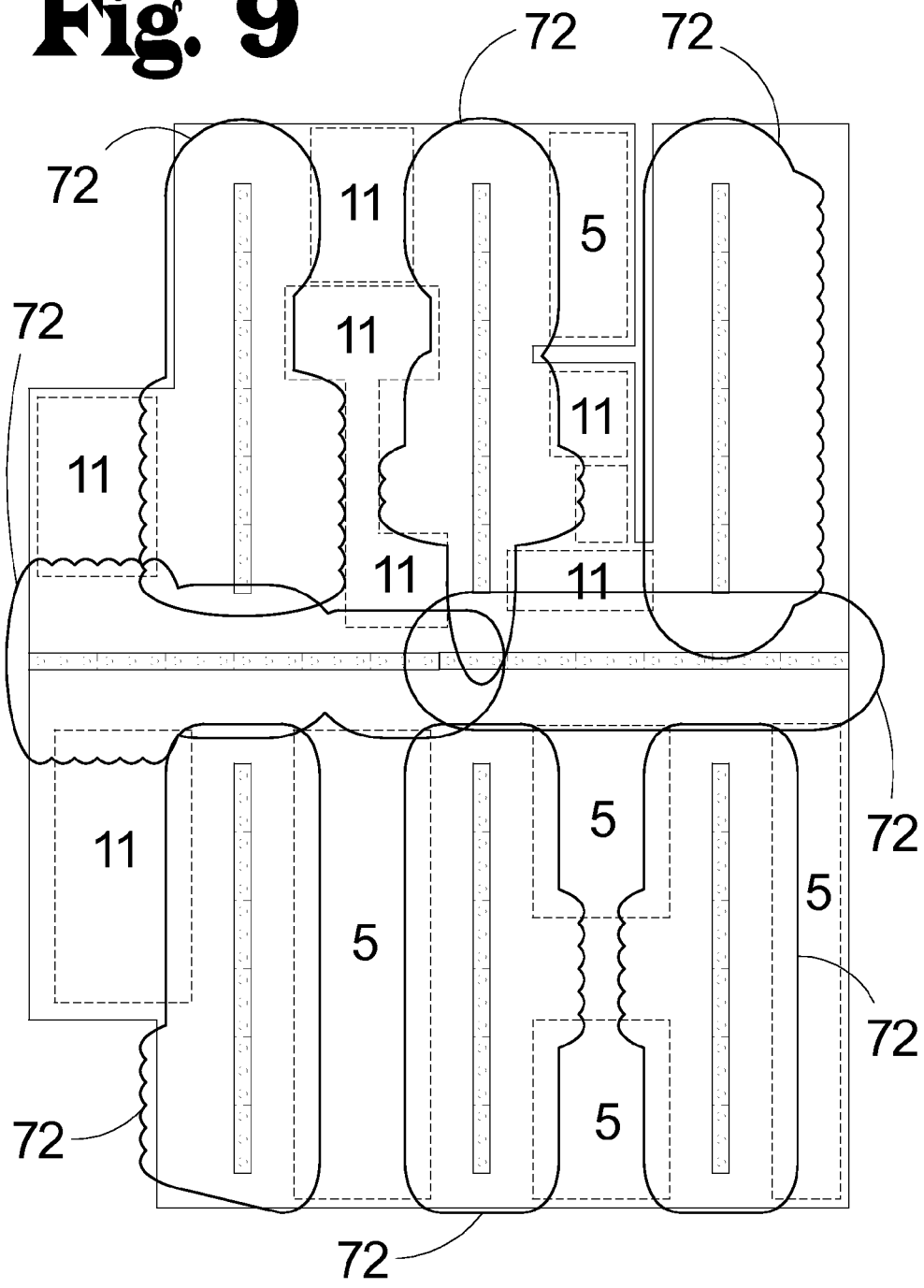
FIG. 9 is a schematic view of a number of a number of fixtures with customized illumination footprints produced various lens combinations conforming to an embodiment of the present invention.

FIG. 9 is a plan view of a warehouse/manufacturing area where the interior area (1) utilizes a number of LED lighting fixtures (20) with customized illumination footprints (72). The illumination footprints (72), in heavy lines, are customized for the pallet racks (5) and manufacturing machinery (11) over which they are mounted. The distribution of light to working areas or surfaces requiring light for optimal operation are all covered and adequately illuminated. The amount of light falling on the rack tops (7) or machinery tops (13) is kept to a minimum making the lighting more efficient.

It should be appreciated from the foregoing description and the many variations and options disclosed that, except when mutually exclusive, the features of the various embodiments described herein may be combined with features of other embodiments as desired while remaining within the intended scope of the disclosure.

It is to be understood that the above description is intended to be illustrative, and not restrictive. Many other embodiments and combinations of elements will be apparent to those skilled in the art upon reviewing the above description and accompanying drawings. The scope of the invention should, therefore, be determined with reference to the appended claims, along with the full scope of equivalents to which such claims are entitled.

What is claimed is:

1. A light emitting diode lighting fixture comprising:

an elongated fixture base having a trough including an inwardly oriented flange;

a printed circuit board mounted in the fixture base;

a plurality of light emitting diodes linearly mounted on the printed circuit board; and a plurality of bezels, each bezel having a plurality of lenses, a single lens for each light emitting diode, the inwardly oriented flange configured to slidably and removably engage the plurality of bezels mounted to said base by the inwardly oriented flange, wherein the printed circuit board is disposed between the fixture base and the bezel wherein the plurality of lenses are chosen from a plurality of lens types to direct light into light output pattern characterized by a specific illumination footprint, and wherein the light output pattern is reconfigurable by exchanging at least one of the plurality of lenses with a lens of another type individually.

2. The LED lighting fixture of claim 1, wherein the lens wherein the lens types comprise a round lens, a cat-eye lens, a bilateral lens, and a composite lens comprising portions of at least two of a round lens, a cat-eye lens, or a bilateral lens.

3. The LED lighting fixture of claim 1, wherein the illumination footprint directs light to areas of desired illumination while not directing light to areas not of desired illumination.

4. The LED lighting fixture of claim 1 wherein the fixture base includes a bezel flange to retain the bezel.

5. The LED lighting fixture of claim 1 wherein the fixture base includes a mounting flange.

6. The LED lighting fixture of claim 1 wherein fixture base includes a fastener receiver.

7. The LED lighting fixture of claim 1 wherein the light emitting diodes are powered by direct current electricity controlled through an interactive system.

8. A method of configuring an LED lighting fixture having an elongated fixture base having a trough including an inwardly oriented flange, a printed circuit board with a plurality of light emitting diodes, the printed circuit board mounted between the base and a plurality of bezels mounted to the base by the inwardly oriented flange, each bezel having a plurality of lenses, each lens aligned with one of the plurality of light emitting diodes, and the inwardly oriented flange configured to slidably and removably engage the plurality of bezels, the method comprising:

providing a single lens for each LED, each lens chosen to contribute to an illumination footprint for the fixture.

9. The method of claim 8, and further comprising:

determining an illumination footprint for the LED lighting fixture; and inserting lenses into the bezel to direct light to form the determined illumination footprint.

10. The method of claim 8, and further comprising:

reconfiguring the lenses to alter the illumination footprint.

11. A light emitting diode (LED) lighting system, comprising:

a plurality of LED lighting fixtures, each of the plurality of LED lighting fixtures individually configurable to provide lighting having a particular illumination footprint corresponding to a portion of a specific space, the plurality of LED lighting fixtures having a combined illumination footprint for the whole of the specific space; and wherein each of the plurality of LED lighting fixtures comprises:

a fixture base having an inwardly oriented flange;

a printed circuit board including;

a light emitting diode mounted to the printed circuit board, the printed circuit board mounted to the fixture base to sink heat from the light emitting diode through the fixture base; and a bezel mounted to said base by the inwardly oriented flange, wherein the printed circuit board is disposed between the fixture base and the bezel, the bezel including a single lens disposed in relation to each said light emitting diode to provide a light output pattern characterized by its particular illumination footprint, the inwardly oriented flange configured to slidably and removably engage the bezel.

12. The LED lighting system of claim 11, wherein the bezel includes a plurality of single lenses, each single lens mounted in a bezel opening, the lens type chosen to contribute to the specific illumination footprint.

13. The LED lighting system of claim 12, wherein each LED lighting fixture includes multiple bezels to produce multiple light output patterns resulting in its particular illumination footprint.

14. The LED lighting system of claim 11, wherein each single lens comprises one of a round lens, a cat-eye lens, a bilateral lens, or a composite lens comprising portions of at least two of a round lens, a cat-eye lens, or a bilateral lens.

15. The LED lighting system of claim 11, wherein the particular illumination footprint directs light to areas of desired illumination while not directing light to areas not of desired illumination.

16. The LED lighting system of claim 11, wherein the combined illumination footprint directs light to areas of desired illumination while not directing light to areas not of desired illumination.

17. The LED lighting system of claim 11, wherein each fixture base is elongated, and wherein each fixture base includes a plurality of LEDs linearly mounted on the printed circuit board.

18. The LED lighting system of claim 11, wherein the LEDs are powered by direct current electricity controlled through an interactive system.

* * * * *